US006325652B1

(12) United States Patent
Grant

(10) Patent No.: US 6,325,652 B1
(45) Date of Patent: Dec. 4, 2001

(54) CONNECTOR MOUNTING CONSTRUCTION, A CONNECTOR AND A HOLDER THEREFOR

(75) Inventor: Matthew Grant, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/679,689

(22) Filed: Oct. 5, 2000

(30) Foreign Application Priority Data

Oct. 27, 1999 (JP) ..... 11-305022

(51) Int. Cl.[7] ..... H01R 13/64
(52) U.S. Cl. ..... 439/248
(58) Field of Search ..... 439/248, 247, 439/571, 34, 573, 572, 329; 296/152, 146, 39.1; 307/10.1; 359/212

(56) References Cited

U.S. PATENT DOCUMENTS

| | | | | |
|---|---|---|---|---|
| 4,909,748 | | 3/1990 | Kozono et al. . | |
| 5,407,363 | * | 4/1995 | Polgar et al. | 439/546 |
| 5,411,409 | * | 5/1995 | Gray et al. | 439/329 |
| 5,871,370 | | 2/1999 | Kameyama et al. . | |
| 5,893,768 | | 4/1999 | Gawron et al. . | |
| 6,011,318 | * | 1/2000 | Mayoras et al. | 307/10.1 |
| 6,115,166 | * | 9/2000 | Kotaki | 359/212 |
| 6,159,030 | * | 12/2000 | Gawron et al. | 439/247 |

FOREIGN PATENT DOCUMENTS

| | | |
|---|---|---|
| 198 14 108 | 10/1999 | (DE) . |
| 0 371 835 | 6/1990 | (EP) . |

* cited by examiner

*Primary Examiner*—Gary Paumen
*Assistant Examiner*—Phuong Chi Nguyen
(74) *Attorney, Agent, or Firm*—Anthony J. Casella; Gerald E. Hespos

(57) ABSTRACT

A connector mounting construction includes a male housing (50) with a receptacle (52) into which a mating female housing is fittable. The male housing (50) has a shaft (53) that extends along an axis of connection (Z-axis direction) with the female housing, and a planar base (57). A holder (70) is provided with an accommodating portion (73) for accommodating the base (57), and holds the male housing (50) for sliding movement in directions normal to the axis of connection and for rotation about the axis of connection. Four elastic ribs (82F, 82R) are provided to be located around the shaft (53), so that the male housing (50) is biased to a specified proper position. Rotation of the male housing (50) about the axis of connection is restricted by contact of the base (57) with side walls (75) or a rear wall (76) of the accommodating portion (73).

8 Claims, 8 Drawing Sheets

CONNECTOR MOUNTING CONSTRUCTION, A CONNECTOR AND A HOLDER THEREFOR

BACKGROUND OF THE INVENTION

1. Field of the Invention.

The present invention relates to a connector mounting construction for mounting a housing in a sliding and/or floating state. The invention also relates to a connector and to a holder for such a connector mounting construction.

2. Description of the Related Art.

The assembly of a vehicle often requires male and female housings to be connected with each other in a difficult place, such as at a rear side of a panel. To facilitate this connecting operation, one of the housings is mounted in a displaceable or floating state. Thus, if a mating attempt is made with a mating housing that is displaced from an axis of connection, the floating housing moves or floats transversely to oppose and align with the mating housing so that the two housings can be connected properly with each other.

An example of such a connector mounting construction is disclosed in U.S. Pat. No. 5,893,768, and is described with reference to FIGS. 7 and 8. More particularly, as shown in FIG. 7, a door frame 1 is provided with three electric devices 2, such as a power window device, and each electric device 2 is provided with a male housing 4 formed with a receptacle 3. FIG. 7 also shows a trim panel 5 that is to be assembled into the door frame 1. The trim panel 5 is provided with switches (not shown), such as a power window switch. Female housings 6 are provided for connection with the switches and are mounted in a floating state in positions to face the corresponding male housings 3 on the door frame 1.

Each female housing 6 is comprised of a fittable portion 7 and a mount portion 8 that is assembled integrally with the fittable portion 7, as shown in FIG. 8. Additionally, each female housing 6 is mounted on the trim panel 5 via a holder 9 and a bracket 11. Each fittable portion 7 is fit into the corresponding receptacle 3 of the male housing 5 along the Z-axis of FIGS. 7 and 8. The movement of the fittable portion 7 into the receptacle 3 is facilitated by a slanted outer peripheral surface 12 at the leading end of the fittable portion 7. Further, each mount portion 8 is provided with a mount plate 13 that is mountable on the rear side of the fittable portion 7. A cylindrical shaft 15 extends from the mount plate 13 along an axis of connection of the male and female housings 4 and 6 (Z-axis direction), and a disk-shaped base 16 is provided at the leading end of the shaft 15. Four elastic pieces 17 are cantilevered from the outer periphery of the base 16.

The prior art holder 9 is provided with a rectangular accommodating portion 18 for accommodating the base 16, and an upper wall of the accommodating portion 18 is formed with a circular hole 19 through which the shaft 15 can be inserted. Further, three mount holes 23 are provided around the accommodating portion 18. The female housing 6 can be slid with respect to the holder 9 in directions (X-axis and Y-axis directions) normal to the Z-axis direction, and is constantly biased toward its center position in the accommodating portion 18 by contact between the respective elastic pieces 17 and the inner wall of the accommodating portion 18. Further, the bracket 11 has a triangular plate 21 secured to the trim panel 5. Struts 22 project from the three corners of the plate 21, and the bracket 11 is held to the holder 9 by fitting the leading ends of the respective struts 22 into the mount holes 23 of the holder 9.

The male and female housings 4 and 6 are connected with each other by assembling the trim panel 5 into the door frame 1 in the Z-axis direction. If the male and female housings 4 and 6 are displaced from their axes of connection when the trim panel 5 is brought closer to the door frame 1, the female housings 6 will shift or float to face and align with the male housings 4, thereby enabling the housings 4 and 6 to be connected properly with each other.

However, in the above construction, the female housings 6 sometimes rotate with respect to the holders 9, if, for example, the male housings 4 are brought laterally into contact with the female housings 6 by mistake when the trim panel 5 is assembled into the door frame 1. Female housings 6 that rotate excessively with respect to the holders 9, may not return to their original positions and, therefore, could not be connected with the male housings 4.

In view of the above problem, an object of the present invention is to provide a connector mounting construction, a corresponding connector and a corresponding holder, which can prevent a housing mounted in a floating state from excessively rotating with respect to a holder.

SUMMARY OF THE INVENTION

The subject invention is directed to a connector mounting construction that comprises a housing main body with a housing that is connectable with a mating housing along an axis of connection. The housing main body further comprises a base that preferably is substantially in the form of a flat plate that extends in directions substantially normal to the axis of connection. The connector mounting construction further comprises a holder with an accommodating portion for movably accommodating the base substantially in a plane that includes the base. The accommodating portion allows the base to translate in its plane and to rotate or pivot around the axis of connection. A restricting portion is provided in the accommodating portion for contacting the base when the housing main body is displaced by a specified angle, thereby preventing any further angular displacement of the housing main body.

According to a preferred embodiment, the housing main body further comprises a shaft that extends substantially along the axis of connection from a side of the housing substantially opposite from a side to which the mating housing approaches.

Preferably, the connector mounting construction further comprises elastic portions that substantially surround the shaft in use. The elastic portions permit the housing main body to move substantially normal to the axis of connection and to displace angularly about the axis of connection. However, the elastic portions bias the housing main body to an original position after a movement and/or an angular displacement.

Accordingly, the housing main body will slide to face and align with a mating housing that is displaced from the axis of connection as the two housings are being connected. Thus, the housings can be connected properly. The elastic portions bias the housing main body to the original position with respect to the holder, and thus prevent the housing main body from assuming a permanently misaligned position. Further, a rotation-restricting portion prevents the housing main body from rotating excessively about the axis of connection.

The shaft preferably has a polygonal cross section, and the number of the elastic portions conforms to the number of the sides of the polygonal cross section of the shaft. The respective elastic portions face the corresponding sides of the shaft and thus bias the shaft toward the original position.

Each elastic portion preferably comprises two or more legs connected with the holder, such that the elastic portion has a closed hollow shape. Accordingly, the closed hollow elastic portions have improved strength as compared with conventional cantilevered elastic pieces.

The holder preferably comprises an insertion opening that enables the base to be inserted into the accommodating portion. The insertion opening extends substantially normal to the axis of connection, and preferably one or more stoppers project from the edge of the insertion opening in directions to narrow the insertion opening. The base comprises one or more locking portions that contact the stoppers and prevent the base from coming out of the accommodating portion. At least one of the stoppers and the locking portions are elastically deformable and permit the locking portions to pass the insertion opening. Accordingly, the base is inserted into the accommodating portion through the insertion opening while elastically deforming the stoppers or the locking portions. The base is prevented from coming out of the accommodating portion by the contact of the locking portions with the stoppers.

These and other objects, features and advantages of the present invention will become apparent upon reading of the following detailed description of preferred embodiments and accompanying drawings.

DETAILED DESCRIPTION OF THE PREFERRED EMBODIMENT

Figure 1:
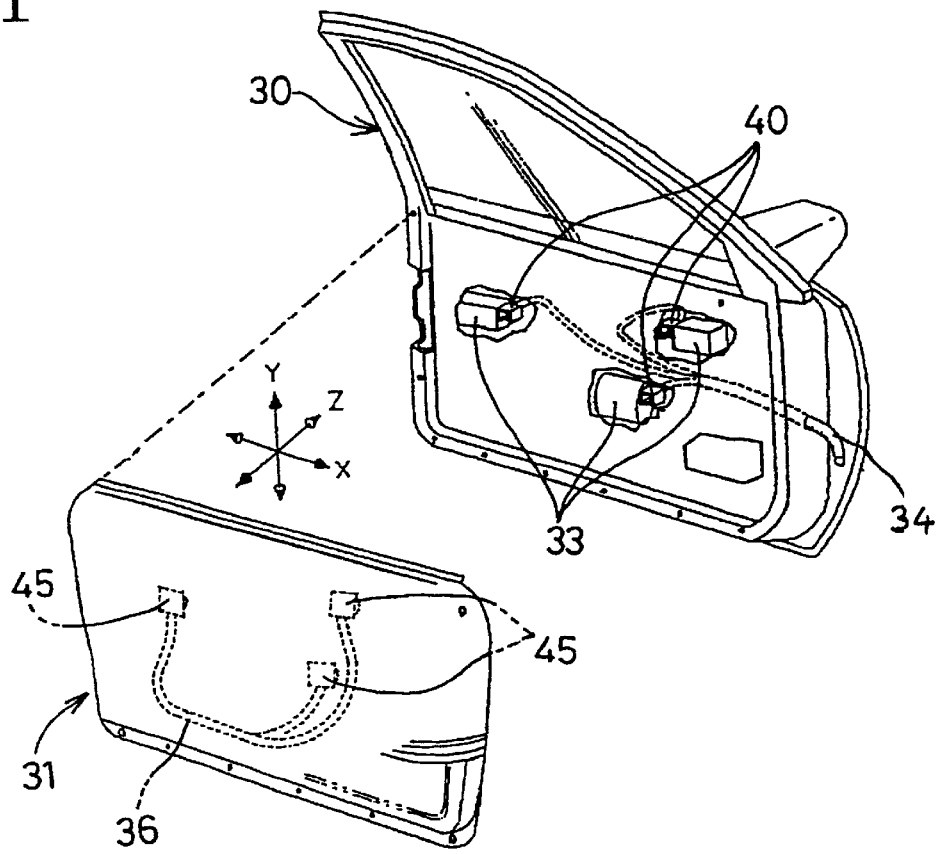
FIG. 1 is a perspective view showing a state before a trim panel and a door frame are assembled in one embodiment of the invention.
Figure 2:
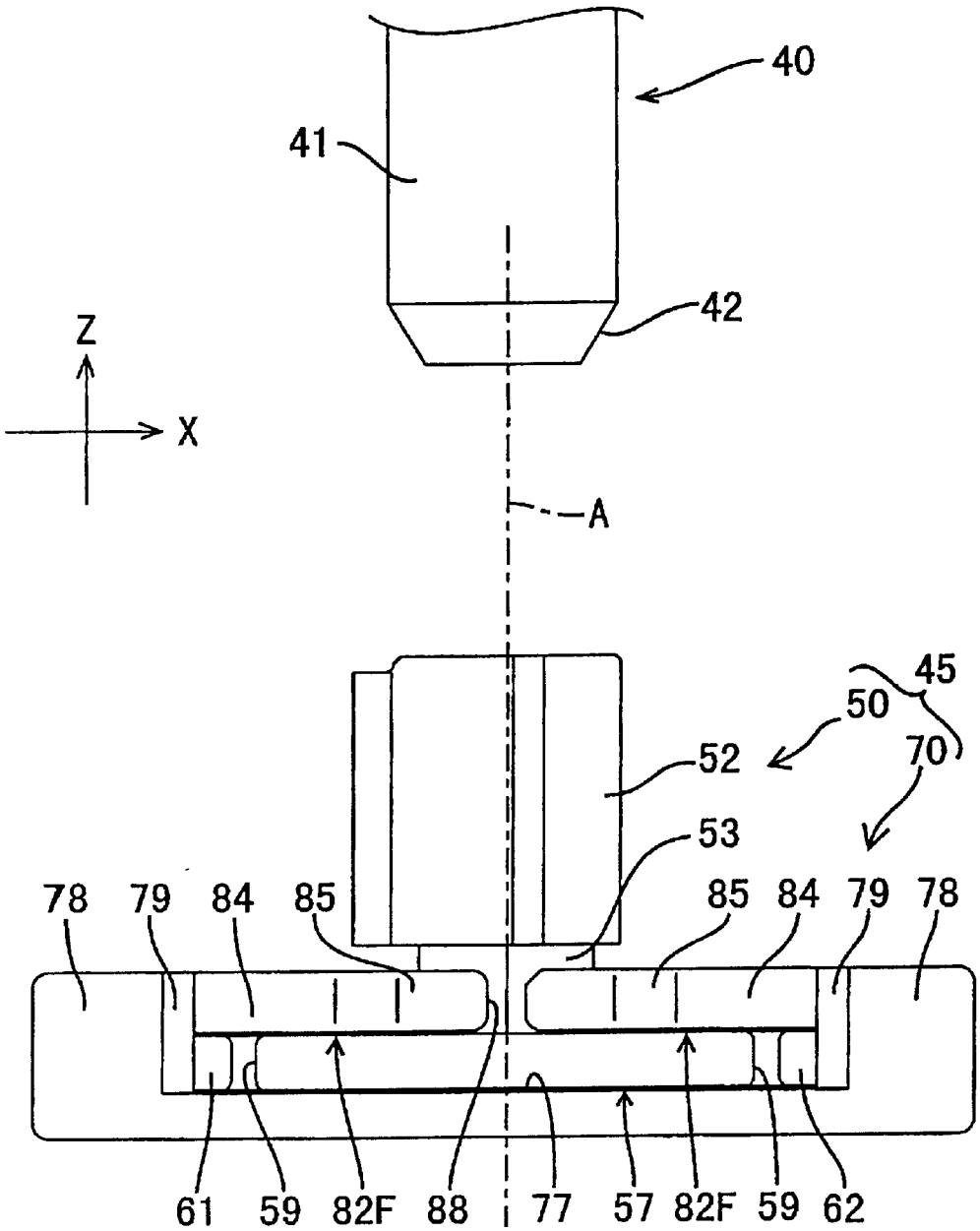
FIG. 2 is a front view of a connector mounting construction and a female housing.

A connector mounting construction in accordance with the subject invention can be applied to a wiring construction of a vehicle door, as shown in FIG. 1. More particularly, FIG. 1 shows a door frame 30 and a trim panel 31 to be mounted inside or on the door frame 30 before they are assembled. The door frame 30 has three electric devices 33, such as a power window device, a door mirror driving device and a door locking mechanism. The devices 33 preferably are connected with an electric device or circuit in a vehicle body via a wire or wiring harness 34. Female housings 40, as shown in FIG. 2, are secured to the electric devices 33. In FIGS. 2 to 6, the Z-axis represents a mounting direction of the trim panel 31 on the door frame 30, while the X-axis and Y-axis represent transverse and vertical directions, respectively when the trim panel 31 is mounted.

The trim panel 31 has switches (not shown) for operating the power window device, etc. The trim panel 31 also has connector mounting constructions 45 (see also FIG. 2), each of which includes a male housing 50 in a position to face the corresponding female housing 40 of the door frame 30. The male housings 50 can be connected with the switches via a wire or wiring harness 36. As described below, the female and male housings 40 and 50 can be connected with each other by mounting the trim panel 31 on the door frame 30 in the Z-axis direction to complete the wiring operation for the door.

Figure 3:
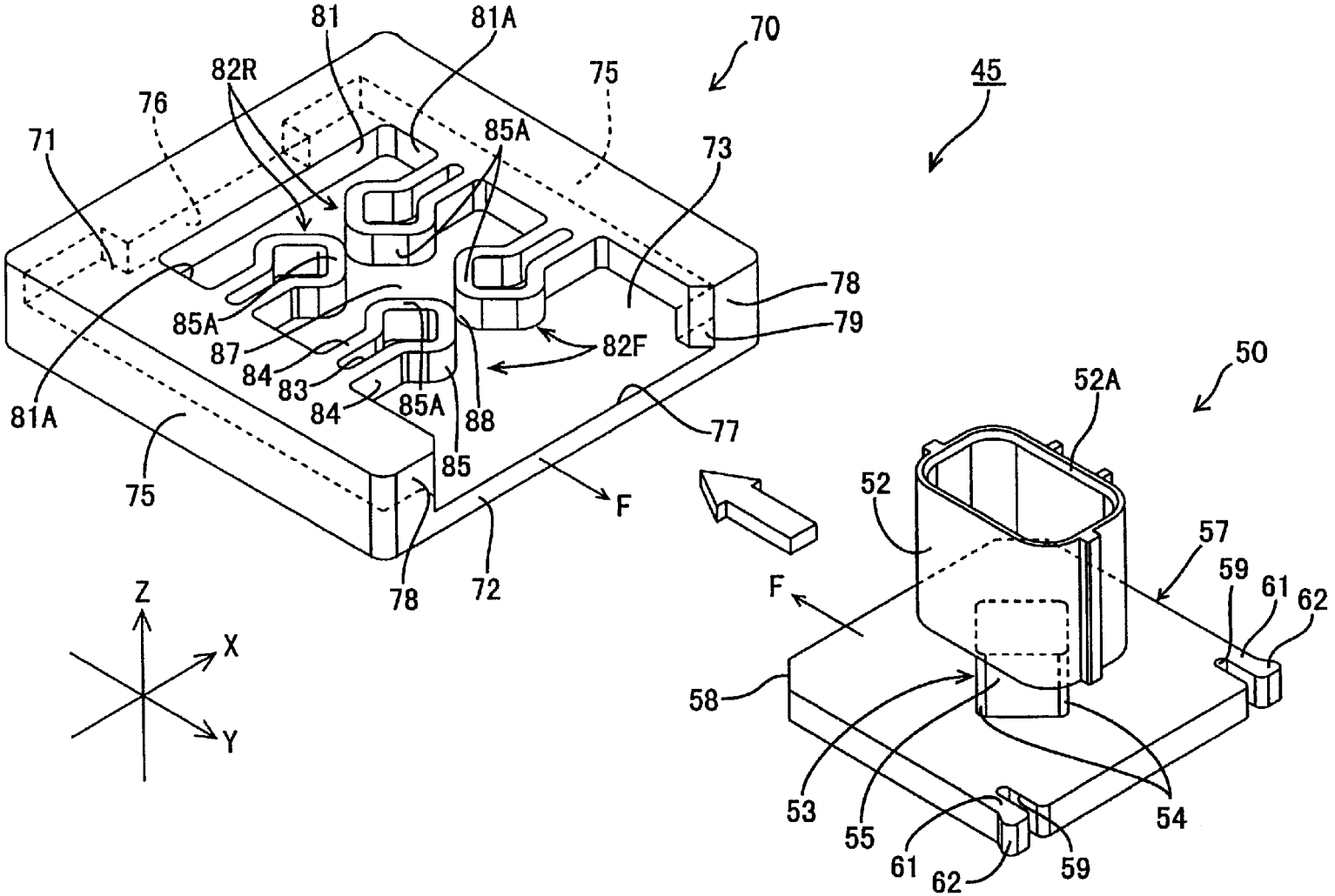
FIG. 3 is a perspective view showing a state before a male housing is assembled with a holder.

Each female housing 40 is formed e.g. of a synthetic resin and has a substantially rectangular fittable portion 41 that preferably has rounded corners. The fiftable portion can be fit at least partly into a receptacle 52 of the male housing 50, as shown in FIGS. 2 and 3 and as described in detail later. The fittable portion 41 and the receptacle 52 are fitted to each other substantially along an axis of connection A, which is parallel to Z-axis, as shown FIG. 2. A rear part of the female housing 40 is fixed to the electric device 33, but is not shown for the sake of convenience. The leading end of the fittable portion 41 is formed with a slanted surface 42 substantially along its outer periphery, and thus is tapered toward its end. Unillustrated female terminal fittings are provided inside the fittable portion 41 and are connected electrically with the electric devices 33.

The connector mounting construction 45 includes a holder 70. The holder 70 can be secured to the trim panel 31, and the male housing 50 can be mounted in the holder 70, as shown in FIGS. 2 and 3.

The male housing 50 is formed unitarily e.g. of a synthetic resin and includes the receptacle 52, a shaft 53 and a base 57. The receptacle 52 preferably is in the form of a substantially rectangular tube with rounded corners, so that the receptacle 52 substantially conforms to the outer shape of the female housing 40. The receptacle 52 includes a slanted surface 52A along the inner side of an entire opening edge. Male terminal fittings (not shown) are connected with the wires 36 and project in the receptacle 52, so that the female and male terminal fittings can be connected with each other when the receptacle 52 and the fittable portion 41 of the female housing 40 are fitted properly to each other.

Figure 5:
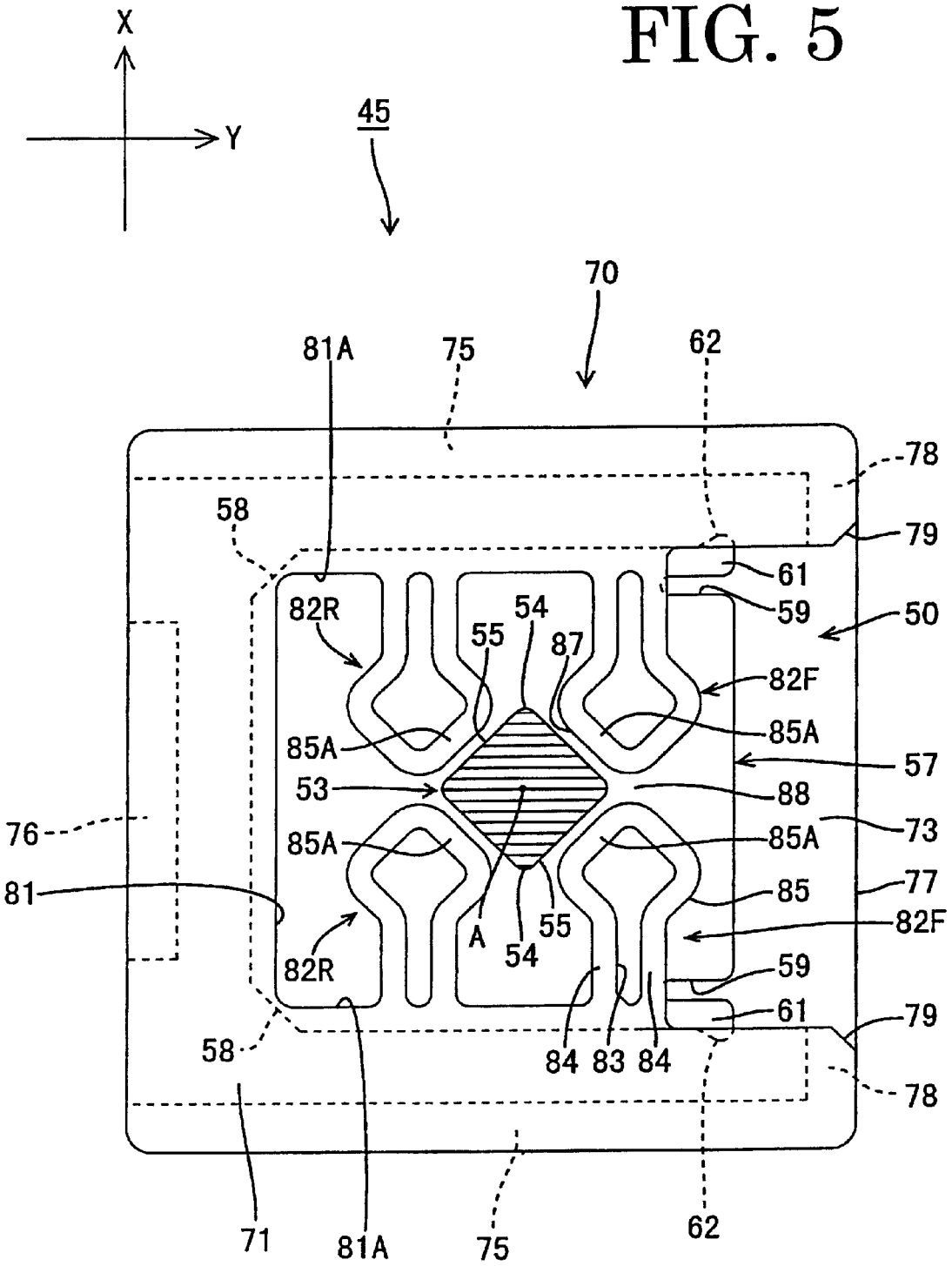
FIG. 5 is a plan view in section of the connector mounting construction when the male housing is in a proper position.
Figure 6:
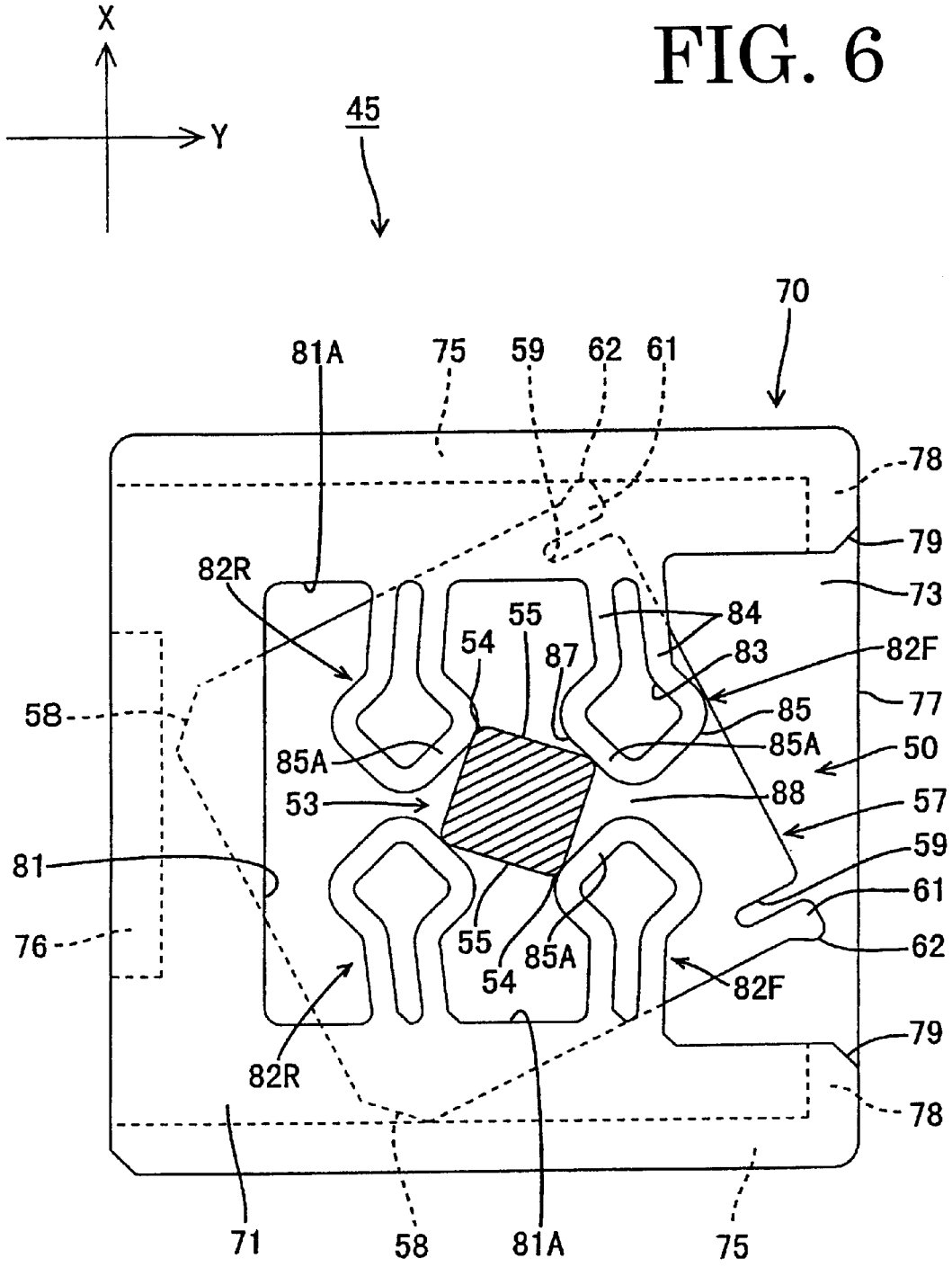
FIG. 6 is a plan view in section showing a state where rotation of the male housing is restricted.
Figure 7:
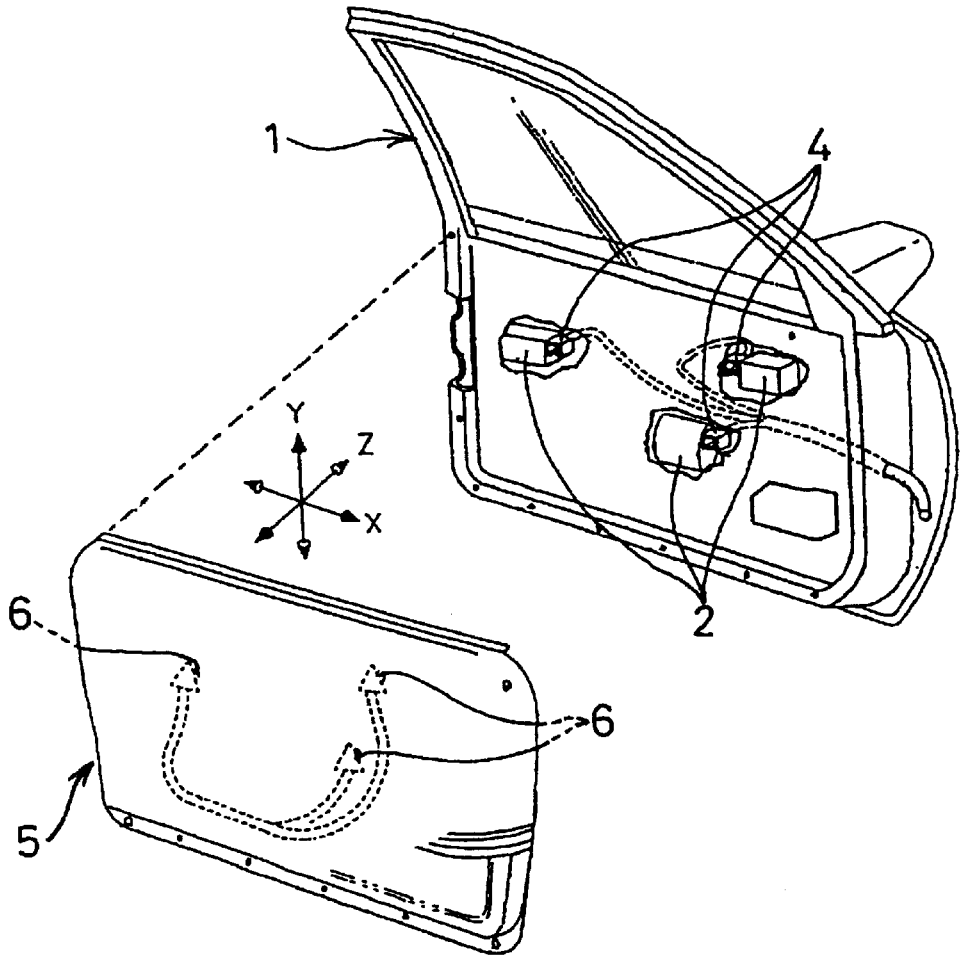
FIG. 7 PRIOR ART
FIG. 7 is a perspective view showing a state before a trim panel and a door frame are assembled according to a prior art.
Figure 8:
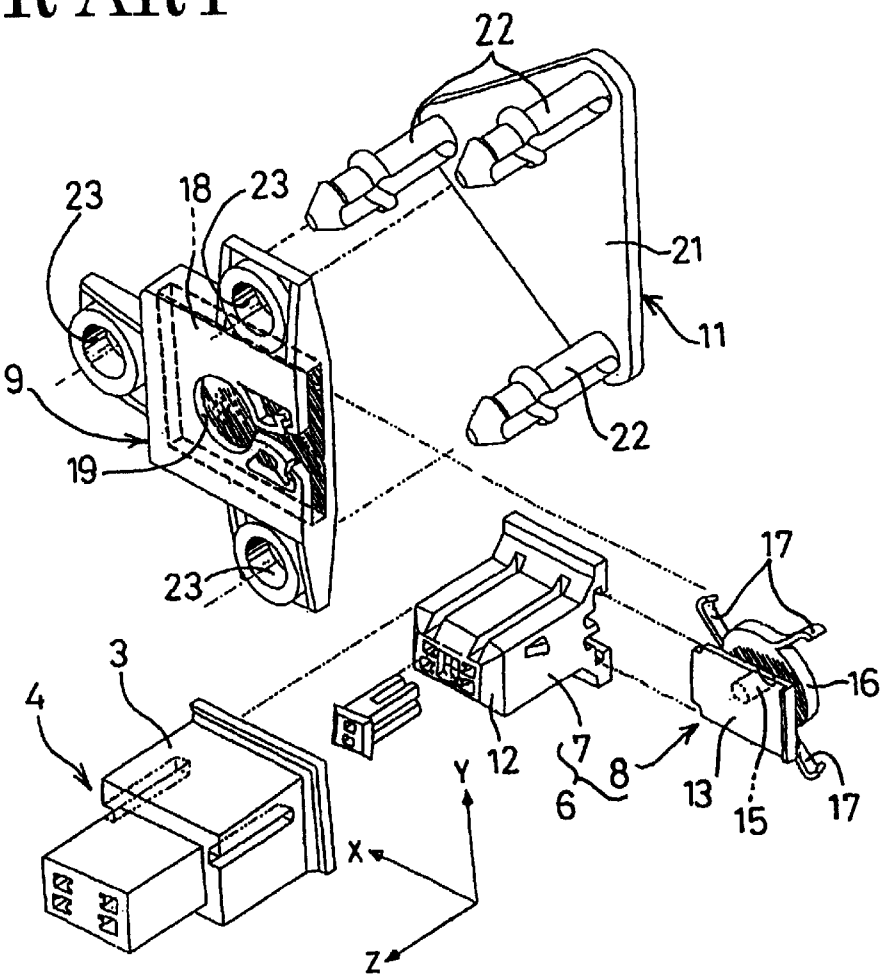
FIG. 8 PRIOR ART
FIG. 8 is a perspective view of a connector mounting construction according to the prior art.

The shaft 53 extends from the side of the receptacle 52 opposite the side into which the female housing 40 is fitted. As shown in FIG. 5, the shaft 53 has a substantially rectangular or square cross section and is formed at its outer periphery with four corners 54 projecting in X-axis and Y-axis directions from its center. Four contact surfaces 55 extend between the corners 54. The base 57 is at the leading end of the shaft 53, and defines a flat plate aligned substantially normal to Z-axis (parallel to a X, Y- plane). In the following description, the sides of the base 57 and the holder 70 to be connected with each other (sides indicated by arrow F in FIG. 3) are referred to at the front sides, and Y-axis, X-axis and Z-axis directions correspond to forward and backward directions, transverse direction and vertical directions, respectively. These directions differ from vertical and transverse directions when these members 57, 70 are mounted on the trim panel 31.

The base 57 has a substantially square cross section with sides that extend in X-axis and Y-axis directions, and left and right corners at the front end of the base 57 (toward the holder 70) are cut off to form slanted surfaces 58. The rear end of the base 57 is characterized by cuts 59 that extend forwardly from locations in proximity to the left and right corners. Locking pieces 61 are formed outside each cut 59 with respect to the widthwise direction (X-axis direction), and are elastically deformable inwardly. A locking portion 62 is provided at the leading end of each locking piece 61, and projects outward in the widthwise direction from the base portion 57.

The holder 70 is formed unitarily e.g. of a synthetic resin and is a substantially square box with sides that are equal in forward and backward directions and transverse directions (X-axis, Y-axis directions). The holder 70 includes an upper wall 71 and a substantially square bottom wall 72 with an accommodating portion 73 therebetween. The accommodating portion 73 has a substantially rectangular or square shape larger than the base 57, and the male housing 50 and/or the female housing 40 can be held in the holder 70 by positioning the base 57 in the accommodating portion 73. Sidewalls 75 are formed at the left and right sides of the accommodating portion 73, and a rear wall 76 is provided at the rear end of the accommodating portion 73. The rear wall 76 is formed with openings near the sidewalls 75. An insertion opening 77 is formed in the front surface of the accommodating portion 73 for receiving the base 57, and stoppers 78 project inwardly from the opposite edges of the insertion opening 77 with respect to its widthwise direction. The width of the insertion opening 77 is set slightly larger than the width of the base 57, but smaller than a distance between projecting ends or tips of the locking portions 62. Thus, contact between the locking portions 62 and the stoppers 78 can prevent the base 57 from coming out of the accommodating portion 73. Further, insertion of the base 57 through the insertion opening 77 and into the accommodating portion 73 causes the locking pieces 61 to deform elastically inward with respect to the widthwise direction, so that the locking portions 62 can pass the insertion opening 77. The outer ends of the stoppers 78 include slanted surfaces 79 for guiding the base 57 through the insertion opening 77.

Figure 4:
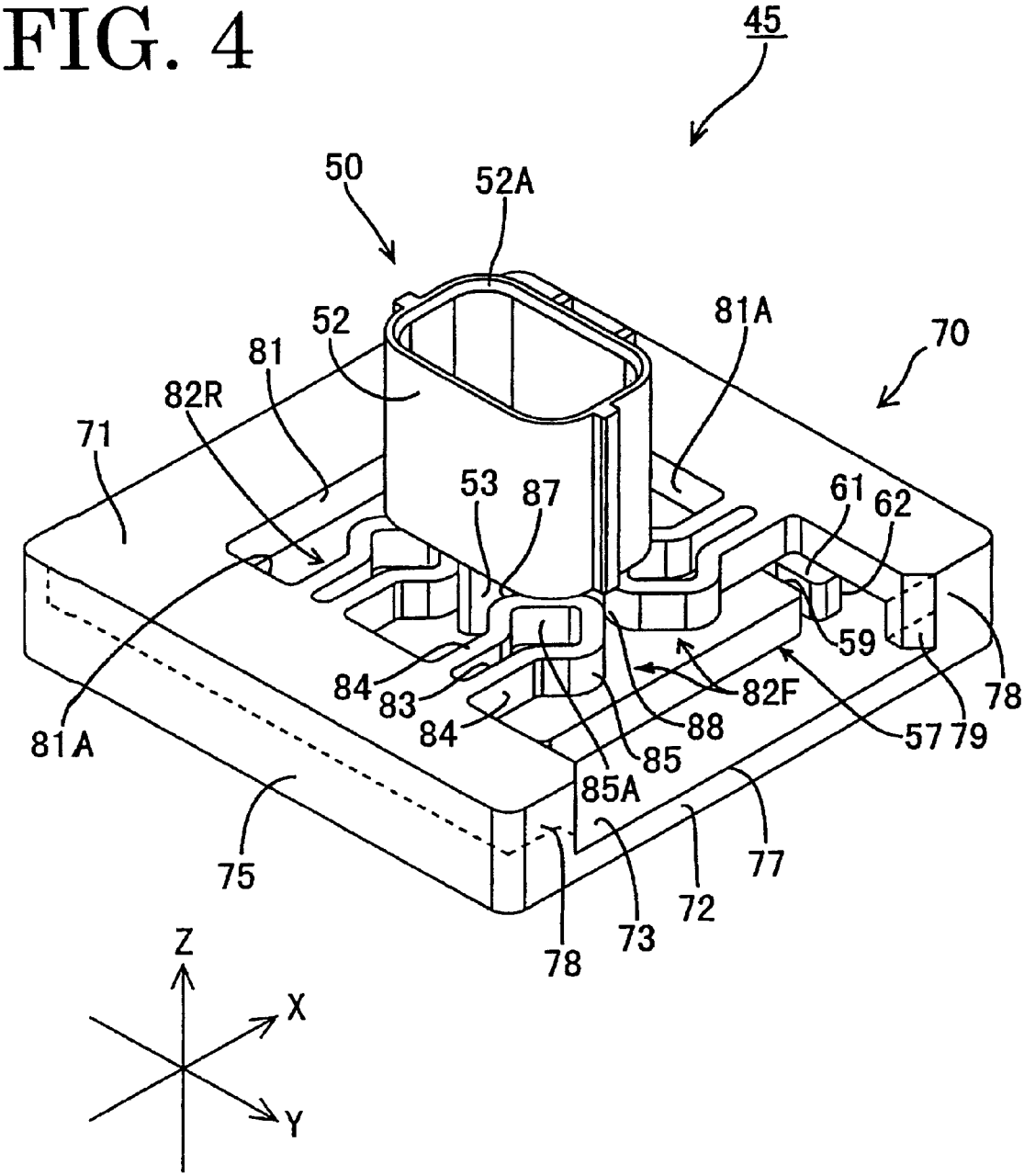
FIG. 4 is a perspective view showing a state where the male housing is assembled with the holder.

A proper position or orientation of the male housing 50 in the accommodating portion 73 of the holder 70 is shown in FIGS. 2, 4 and 5. In this proper position, the base 57 is located substantially in the center of the accommodating portion 73. The base 57 can be slid to the front, back, left and right (along X-axis, Y-axis directions) from the proper position and can be rotated about the Z-axis. However, rotation of the base 57 is restricted, preferably to less than about 450, by contact of the corner(s) of the base 57 with the sidewalls 75 or the rear wall 76, as shown, for example, in FIG. 6.

The upper wall 71 of the holder 70 is formed with a cut-away portion 81 that has a substantially U-shaped contour continuous with the insertion opening 77. A pair of front elastic ribs 82F and a pair of rear elastic ribs 82R project from left and right edges 81A of the cut-away portion 81 to face or oppose each other in a transverse direction. Each elastic rib 82F 92P has a pair of legs 84 that extend substantially perpendicularly from the corresponding side edge 81A of the cut-away portion 81. A substantially square leading end 85 is formed at the leading ends of the legs 84 such that the opposite corners of the square leading end 85 are located in X-axis and Y-axis directions. An opening 83 is formed between the legs 84 and inside the leading end 85. Thus the elastic ribs 82F and 82R have a closed hollow shape.

Sides of the leading ends 85 of the four elastic ribs 82F, 82R that face the center of the holder 70 are referred to as facing sides 85A. A substantially rectangular or squared bearing hole 87 is formed in the center of the holder 70 by the four facing sides 85A. The size of the bearing hole 87 is slightly larger than that of the shaft 53. A clearance between the elastic ribs 82F at the front side serves as a shaft insertion opening 88. The shaft 53 can be inserted through the shaft insertion opening 88 by pushing the elastic ribs 82F wider apart. When the base 57 is accommodated in the accommodating portion 73, the shaft 53 is disposed in the bearing hole 87 so that the respective facing sides 85A substantially face the corresponding contact surfaces 55 of the shaft 53. FIG. 5 shows the proper position of the male housing 50 with respect to the holder 70. In this proper position, the shaft 53 is in the bearing hole 87 and the elastic ribs 82F and 82R are not deformed. Thus, the male housing 50 can be slid from the proper position within specified ranges in X-axis and Y-axis directions and can be rotated within a specified range about the Z-axis with respect to the holder 70.

The male housing 50 is assembled with the holder 70 by first inserting the base 57 through the insertion opening 77 from front as indicated by the large arrow in FIG. 3. The slanted surfaces 58 and 79 on the base 57 and the holder 70 respectively enable the inserting operation to be performed smoothly. When the base 57 enters the accommodating portion 73 through the insertion opening 77, the shaft 53 contacts the leading end portions 85 of the left and right elastic ribs 82F, thereby elastically deforming the ribs 82F obliquely outward and backward with respect to the widthwise direction to open the shaft inserting opening 88 more widely.

As the base 57 is pushed further, the elastic ribs 82F deform, and the left and right locking portions 62 contact the slanted surfaces 79. Then, the respective locking pieces 61 deform elastically inward, and the respective locking portions 62 slide inwardly along the slanted surfaces 79. The locking portions 62 eventually move over the stoppers 78, and the locking pieces 61 elastically restore substantially to their original shape. As a result, the locking portions 62 project from the sides of the base 57. Accordingly, contact of the locking portions 62 with the stoppers 78 keeps the base 57 inside the accommodating portion 73 even if the base 57 is biased toward the insertion opening 77.

The shaft 53 subsequently passes through the shaft inserting opening 88 and enters the bearing hole 87. At this point, the elastic ribs 82F are restored substantially to their original shapes and return to their original positions behind the shaft 53, thereby narrowing the shaft insertion opening 88. As a result, the shaft 53 is surrounded at least partly by the four facing sides 85A of the respective elastic ribs 82F, 82R. In this way, the male housing 50 is assembled with the holder 70, and is located in its proper position or orientation with respect to the holder 70 (state shown in FIGS. 2, 4 and 5).

The connector mounting construction 45 can be mounted on the trim panel 31 such that the insertion opening 77 of the holder 70 faces up and the bottom wall TZ is adhered to the inner surface of the trim panel 31.

The male housing 50 may be displaced in X-axis or Y-axis directions with respect to the holder 70 due to a movement of the trim panel 31 or a contact of external matter with the male housing 50 after the connector mounting construction 45 is mounted on the trim panel 31. In this situation, part of the contact surface 55 of the shaft 53 strikes at least one of the facing sides 85A, and elastically deforms the corresponding elastic rib 82F or 82R. At this time, if the male housing 50 is displaced by a specified distance in the X-axis direction, the base 57 contacts one of the side walls 75, thereby preventing the shaft 53 from coming out of the bearing hole 87 through a clearance between the corresponding pair of the elastic ribs 82F, 82R. Likewise, if the male housing 50 is displaced backward (Y-axis direction) by a specified distance, the base 57 contacts the rear wall 76, thereby holding the shaft 53 inside the bearing hole 87.

Further, the locking portions 62 contact the stoppers 78 if the male housing 50 is displaced forward (Y-axis direction) by a specified distance, thereby preventing the base 57 from exiting though the insertion opening 77 and holding the shaft 53 inside the bearing hole 87.

When the male housing 50 is released from the external force, the elastic restoring forces of the elastic ribs 82F, 82R push the shaft 53 back, and, as a result, the male housing 50 is returned to its proper position.

The male housing 50 can be rotated about the Z-axis from the proper position due to an external force. In this situation, parts of the outer surfaces of the shaft 53 (e.g. the corner portions 54) push the facing sides 85A to elastically deform the elastic ribs 82F, 82R. Consequently, the male housing 50 may be rotated until the corners near the tapered surface 58 or the locking portions 62 of the base 57 contact the side walls 75 or the rear wall 76 of the holder 70 to restrict rotation of the base 57. This restriction prevents an excessive rotation of the male housing 50 with respect to the holder 70, and hence the male housing 50 will not rotate 900 from the proper position. When the male housing 50 is released from the external force, the elastic restoring forces of the elastic ribs 82F and 82R cause the shaft 53 to rotate substantially to its original position. As a result, the male housing 50 returns to its proper position.

The male housing 50 is held in its proper position by the biasing forces of the elastic ribs 82F, 92P, as described above. Thug, it is not necessary to return the male housing 50 to its proper position when the male housing 50 is inadvertently moved during the operation. Further, rotation of the male housing 50 beyond a specified amount from the proper position is restricted by the contact of the base 57 with the sidewalls 75 or the rear wall 76. This prevents the male housing 50 from being rotated excessively and, accordingly, prevents the male housing 50 from being unable to return to the proper position.

The female and male housing 40 and 50 are connected by aligning the trim panel 31 to face the door frame 30, as shown in FIG. 1, and then bringing the trim panel 31 closer to the door frame 30 along the Z-axis direction. The female and male housings 40 and 50 may be displaced in X-axis and/or Y-axis directions from the axes of connection A. In this situation, the slanted surfaces 42 and 52A will contact each other as the leading ends of the fittable portions enter the receptacles 52. As the housings 40 and 50 are brought still closer to each other, the tapered surfaces 42 and 52A cause the male housings 50 to slide into positions where they align with the corresponding female housings 40 by elastically deforming one or more of the elastic ribs 82F, 82R. The female and male housings 40 and 50 also may be brought closer to each other while being displaced from each other about the 7-axis. In this situation, the tapered surfaces 42 and 52A will contact each other when the leading ends of the fittable portions 41 enter the receptacles 52. Hence, the male housings 50 rotate about the Z-axis to face and align with the female housings 40.

The fittable portions 41 are inserted further into the receptacles 52 by bringing the trim panel 31 closer to the door frame 30 with the housings 40 and 50 aligned. When the trim panel 31 is aligned in a proper mount position with respect to the door frame 30, the male housings 50 return substantially to their proper positions or orientations and the housings 40 and 50 are connected properly with each other. As a result, the terminal fittings in the housings 40 and 50 are connected with each other. Assembly of the door then can be completed by fixing the trim panel 31 to the door frame 30 with unillustrated fastening means.

The trim panel 31 may be misaligned to the door frame 30 to such an extent during assembly that the fittable portions 41 contact the outer surfaces of the receptacles 52, thereby displacing the male housings 50 in X-axis and/or Y-axis directions or rotating them about the Z-axis. However, in such a case, the male housings 50 return to their proper positions or orientations, as described above, if the trim panel 31 is brought away from the door frame 30. Thus, the operation immediately can be started again.

There may be an error in the mount positions of the holders 70 and the female housings 40 between the trim panel 31 and the door frame 30. In this situation, the housings 40 and 50 can be connected with each other in a way similar to the above. Thus, the male housings 50 are displaced to face and align with the female housings 40 after the trim panel 31 is assembled into the door frame 30, thereby compensating for the error.

As described above, the male housing 50 will move to face and align with the female housing 40, if either housing 40 or 50 is displaced in X-axis and/or Z-axis directions from the axis of connection A or if either housing 40 or 50 is displaced about the Z-axis. Thus, a proper connection of the housings 40 and 50 can be achieved.

Further, the male housing 50 is held in its proper position with respect to the holder 70 by the biasing forces of the elastic ribs 82F, 82R. Thus, the male housing 50 is prevented from being inadvertently moved with respect to the holder 70 before being connected with the female housing 40.

Furthermore, when the male housing 50 is rotated about the Z-axis by a specified amount, the base 57 contacts the side walls 75 or the rear wall 76 of the holder 70 to restrict the rotation of the holder 70. Thus, for example, the male housing 50 will not be turned by 90° from its proper position.

The shaft 99 has a substantially rectangular or square cross section, and the four elastic ribs 82F, 82R are provided with facing sides 85A that substantially face the corresponding sides of the shaft 53. Hence, the shaft 53 can be biased to its proper position along X-axis and Y-axis directions and about the Z-axis.

Further, each of the elastic ribs 82F, 82R includes a pair of legs 84 and has a closed hollow shape. Therefore, each rib 82F and 82R has an improved strength as compared to the one in the form of a cantilever.

Furthermore, the base portion 57 is prevented from coming out of the accommodating portion 73 by contact of the locking portions 62 with the stoppers 78. The locking portions 62 can pass the insertion opening 77 by elastically deforming the locking pieces 61.

The present invention is not limited to the above embodiment. For example, following embodiments are also embraced by the technical scope of the invention as defined in the claims. Besides these embodiments, various changes can be made without departing from the scope and spirit of the invention as defined in the claims.

Although the inventive connector mounting construction is applied to the vehicle door in the foregoing embodiment, the present invention is also applicable to other parts of the vehicle.

Although the male housing 50 is in the floating state in the foregoing embodiment, the female housing may be in a floating state with the male housing fixed according to the present invention.

Although the mating female housings 40 are fixed to the door frame 30 in the foregoing embodiment, the present invention is also applicable even if the mating housings are not fixed. In such a case, if the elastic ribs are held in close contact with the shaft portion to constantly bias the shaft portion to the proper position or orientation, the female and male housings can be held in the proper position with respect to the holder even if a vehicle or the like is moved after assembling, thereby preventing the female and male housings from shaking.

Although the shaft 53 has a substantially square cross section in the foregoing embodiment, the shape thereof is not limited to it. For example, the shaft 53 may have a shape of a quadrilateral such as a rectangle or a rhombus, a triangle or a pentagon or the like polygon. Then, the number of elastic ribs is preferably adapted to the type of polygon.

Although the four elastic ribs 62F, 62R having a closed hollow shape are provided in the foregoing embodiment, the number thereof is not limited thereto according to the present invention. Further, the shape of the shaft 53 is not limited to the one of the foregoing embodiment, and may take a shape of a cantilever.

Although the locking portions 62 are enabled to pass the insertion opening 77 by the inward elastic deformation of the locking pieces 61 with respect to widthwise direction in the foregoing embodiment, the stoppers may, conversely, be made elastically deformable according to the present invention.

A part of the ribs 82F; 82R may be rigid or semi-rigid so that the other ribs 82F, 82R with elastic properties exert the biasing force in the desired direction, i.e. to substantially return the shaft 53 and the male housing 50 to its proper position or orientation.

What is claimed is:

1. A connector mounting construction, comprising:

a housing main body comprising: a housing portion connectable with a mating housing along an axis of connection, a shaft extending along the axis of connection from a side of the housing opposite a side to which the mating housing is connectable, the shaft having a polygonal cross-section with a plurality of sides, and a substantially planar base disposed on the housing main body and aligned substantially normal to the axis of connection, a holder comprising an accommodating portion for movably accommodating the base, the accommodating portion being dimensioned to allow translation of the base in the plane of the base and rotation of the base around the axis of connection, a restricting portion provided in the accommodating portion for contacting the base when the housing main body is displaced by a specified angle, thereby preventing any further angular displacement of the housing main body, and elastic portions conforming in number to the sides of the shaft and arranged substantially around the shaft and to face the corresponding sides of the shaft, the elastic portions permitting the housing main body to move substantially normal to the axis of connection and to angularly displace about the axis of connection, the elastic portions biasing the housing main body and the shaft toward an original position.

2. A connector mounting construction according to claim 1, wherein each said elastic portion comprises two leg portions connected with the holder, such that each said elastic portion defines a closed hollow shape.

3. A connector mounting construction according to claim 1, wherein the accommodating portion is defined by a substantially planar bottom wall, a first and second side walls extending from the bottom wall, and a rear wall extending from the bottom wall, an insertion opening into the accommodating portion being defined between the side walls and opposite the rear wall, the insertion opening being dimensioned to receive the base.

4. A connector mounting construction according to claim 3, wherein the housing main body further comprises a shaft of substantially square cross section extending substantially along the axis of connection between the base and the housing portion.

5. A connector mounting construction comprising:

a housing main body comprising a housing portion connectable with a mating housing along an axis of connection and a substantially planar base disposed on the housing main body and aligned substantially normal to the axis of connection;

a holder comprising an accommodating portion for movably accommodating the base, the accommodating portion being dimensioned to allow translation of the base in the plane of the base and rotation of the base around the axis of connection, the holder comprises an insertion opening to the accommodating portion, the insertion opening being dimensioned to receive the base and extending substantially normal to the axis of connection, at least one stopper projecting from the edge of the insertion opening in a direction to narrow the insertion opening, the base comprising at least one locking portion for engaging the stopper and preventing the base from coming out of the accommodating portion, at least one of the stopper and the locking portion being elastically deformable to permit the locking portion to pass the insertion opening; and a restricting portion provided in the accommodating portion for contacting the base when the housing main body is displaced by a specified angle, thereby preventing any further angular displacement of the housing main body.

6. A connector mounting construction comprising:

a housing main body comprising a housing portion connectable with a mating housing along an axis of connection, a shaft extending from the housing portion substantially along the axis of connection, the shaft having a substantially square cross-section, and a substantially planar base disposed on the shaft and aligned substantially normal to the axis of connection, a holder comprising an accommodating portion having a substantially planar bottom wall, first and second side walls extending from the bottom wall and a rear wall extending from the bottom wall, an insertion opening into the accommodating portion being defined between the side walls and opposite the rear wall, the insertion opening being dimensioned to receive the base, the accommodating portion being further defined by a top wall comprising two first elastic portions extending from the first side wall and two second elastic portions extending from the second side wall, the first and second elastic portions being spaced from one another sufficiently to engage the shaft between the elastic portions, and a restricting portion provided in the accommodating portion for contacting the base when the housing main body is displaced by a specified angle, thereby preventing any further angular displacement of the housing main body.

7. A connector mounting construction according to claim 6, wherein said square shaft includes four outer contact surfaces, each elastic portion including an engaging face aligned to a respective contact surface of the shaft.

8. A connector mounting construction according to claim 7, wherein each said elastic portion is a substantially hollow loop with a pair of legs extending from one of said side walls.

* * * * *